United States Patent [19]

Aiga et al.

[11] 4,438,804

[45] Mar. 27, 1984

[54] WATER SOLUBLE CORES AND METHOD FOR MANUFACTURING CAST ROTOR PROVIDED WITH VENTILATION DUCTS UTILIZING THE CORE

[75] Inventors: Toshiro Aiga; Toshiaki Maeda, both of Yokohama, Japan

[73] Assignee: Tokyo Shibaura Denki Kabushiki Kaisha, Kawasaki, Japan

[21] Appl. No.: 321,088

[22] Filed: Nov. 13, 1981

[30] Foreign Application Priority Data

Nov. 20, 1980 [JP] Japan ..... 55-162591

[51] Int. Cl.[3] ..... B22C 1/18

[52] U.S. Cl. ..... 164/522; 164/528; 164/369; 164/132; 106/38.3; 106/38.9

[58] Field of Search ..... 164/522, 525, 528, 529, 164/132, 369; 106/38.3, 38.9, 38.27

[56] References Cited

FOREIGN PATENT DOCUMENTS

| | | | |
|---|---|---|---|
| 44-27802 | 11/1969 | Japan | 106/38.3 |
| 48-15402 | 5/1973 | Japan . | |
| 50-15211 | 6/1975 | Japan . | |
| 50-28057 | 9/1975 | Japan . | |
| 53-14618 | 2/1978 | Japan | 106/38.3 |
| 53-81429 | 7/1978 | Japan | 164/522 |
| 898867 | 6/1962 | United Kingdom | 106/38.3 |

*Primary Examiner*—Kuang Y. Lin

*Attorney, Agent, or Firm*—Stevens, Davis, Miller & Mosher

[57] ABSTRACT

A water soluble core comprises a mold product prepared by a mixture of sand, potassium carbonate as a first binder and at least one of barium carbonate and alkali silicate as a second binder. This water soluble core is utilized for a method of manufacturing a cast rotor for forming ventilation ducts of an induction motor.

7 Claims, 4 Drawing Figures

WATER SOLUBLE CORES AND METHOD FOR MANUFACTURING CAST ROTOR PROVIDED WITH VENTILATION DUCTS UTILIZING THE CORE

BACKGROUND OF THE INVENTION

This invention relates to a water soluble or water disintegrative core adapted for a precision casting for forming spaces in a cast product and also relates to a method for manufacturing a cast rotor of an induction motor provided with ventilation ducts by utilizing the core.

It is well known that solid casting preferably has been carried out by utilizing a core together with members constituting a cast rotor to form spaces in a cast product having a complicated configuration and, as a typical example of this fact, the inventors of this invention have proposed a method for manufacturing a cast rotor provided with ventilation ducts of an induction motor by utilizing a water soluble core, for example, as referred to in the Japanese Laid-open Patent Specification No. 70443/1980. Also well known is a method for manufacturing a cast rotor for a cage-type induction motor provided with conductors, together with short circuit rings and cooling blades, which are formed by pouring molten metal such as aluminium into slots formed by punching iron core plates usually made of silicon steel plates which were preliminarily laminated and clamped. A die casting or low pressure casting method is generally utilized for this purpose. Also known is a cast rotor adapted for an induction motor with a large capacity which is provided with ventilation ducts defined between blocks respectively made of laminated iron core plates for improving the cooling effect during the operation of the motor. In such a cast rotor, the blocks are connected only by conductors.

In a prior art (for example, Japanese Patent Publication No. 15402/1973), for forming ventilation ducts of a cast rotor there has been proposed a method comprising the steps of preliminarily forming duct spacers each having a width equal to that of the ventilation duct and provided with slots similar to those of an iron core plate by using a metal having a low melting point, laminating the spacers between the laminated core blocks, casting conductor metal thereinto, and heating and melting it to its melting point, if necessary, while rotating the rotor to remove molten metal.

However, with this method, the duct spacers made of a metal having a low melting point often melts and enters into the cast conductor when molten aluminum is poured and since workmen must work under a high temperature condition, working efficiency will be lowered. In addition, when the rotor rotates for effectively removing the spacers, the rotor has to be rotated at a low speed to prevent deformation of the conductors, so that it takes much time to remove the spacers. Moreover, this method requires an additional process such as heating process and it is troublesome to control the temperature of the core and the molten metal. For this reason, it may be required to coat a certain heat proof material on the surface near the slots.

Further, a method has been proposed for obviating defects of the methods described above, in which a water soluble core is utilized as a spacer instead of the spacer made of metal having a low melting point. According to this method, the core can be removed by dissolving or disintegrating it with water after the conductor metal has been cast, thus easily forming ventilation ducts.

However, such method as utilizes the water soluble core adapted for a cast rotor provided with ventilation ducts also has problems which are caused by the fact that materials for the water soluble core are not in satisfactory conditions indispensable to a precision casting.

Generally, it is required for the water soluble core or materials therefor to have the following characteristics:

(a) suitable moldability, (b) excellent as cast strength (particularly, which is required in the method for manufacturing a cast rotor provided with ventilation ducts as described hereinbefore in which the core is used in combination with iron core plates, which are clamped for firmly combining them and in a pressure casting method, it is necessary for the core to have an as cast strength to withstand the pressure of the molten metal), (c) prompt disintegration ability, (d) no excess hygroscopicity and to be preserved in a usual dryer, (e) proper dimensional precision, and (f) smooth cast surface.

However, the water soluble core materials of the known types do not always have satisfactory characteristics that can meet the requirements described above.

For example, a mold product of a water soluble salt, for example, consisting of a large amount of sodium carbonate and small amount of barium carbonate (disclosed in the Japanese Patent Publication No. 15211/1975) has an excellent cast strength and smooth cast surface, but has a large thermal expansion coefficient and less dimensional precision in addition to a long time for the disintegration of the water soluble core and high cost for the use of a large amount of the molten salt. Moreover, a kneaded product consisting of alumina sand and water soluble carbonate such as sodium carbonate or potassium carbonate (for example, disclosed in the Japanese Patent Publication No. 28057/1975) has a good disintegration ability and moldability, but has less cast strength, so that such kneaded product can be used for gravity casting process, but cannot be used for low pressure casting process or die casting process and also cannot withstand a pressure at a time when laminated core blocks are clamped together with iron core plates and end plates.

SUMMARY OF THE INVENTION

An object of this invention is to provide a water soluble core consisting of materials which have satisfactory characteristics required for the core of this type.

Another object of this invention is to provide a water soluble core which further comprises a material for preventing formation of cavities in the produced core.

A further object of this invention is to provide a method for manufacturing a cast rotor provided with ventilation ducts which utilizes the water soluble core according to this invention.

According to this invention there is provided, in one aspect, a water soluble core which comprises a mold product prepared by a mixture of a sand, a first binder comprising potassium carbonate, and a second carbonate comprising at least one of barium carbonate and alkali silicate.

Another aspect of this invention, there is provided a method of manufacturing a cast rotor of an induction motor which comprises the steps of preparing a plurality of water soluble cores each comprising a mixture consisting of sand, a first binder comprising potassium carbonate, and a second binder comprising at least one of barium carbonate and alkali silicate, the core being provided with a shaft hole and a plurality of conductor slots, interposing the cores between adjacent laminated core blocks each having a shaft hole and a plurality of slots corresponding to those of the cores so as to align the cores and the laminated core blocks to form a laminated assembly, positioning the laminated assembly in a casting mold, pouring electrically conductive molten metal into the casting mold to form conductors, circuit rings, and cooling fins of the cast rotor, and treating with, by water, a cast product taken out from the mold thereby to disintegrate the water soluble cores to form ventilation ducts.

DESCRIPTION OF THE PREFERRED EMBODIMENTS

Figure 1:
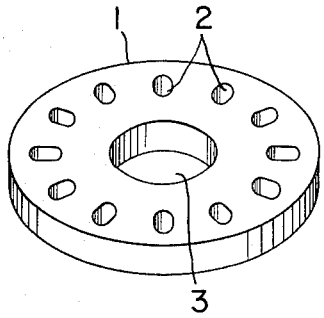
FIG. 1 is a perspective view showing one example of a water soluble core utilized to form ventilation ducts spacer according to this invention.

FIG. 1 shows a perspective view of a water soluble core according to this invention which is utilized as a spacer for forming ventilation ducts of a cast rotor of an induction motor. The core (spacer) 1 is provided with a central shaft hole 3 and a plurality of slots 2 about the hole 3 and the core 1 consists of casting sand, potassium carbonate acting as a first binder, barium carbonate and/or sodium silicate acting as a second binder, and a suitable amount of water. After these materials have been kneaded or mixed, the mixture is charged into a wooden or foarmed plastic mold frame having a predetermined shape, rammed and dried.

Casting sand such as alumina sand, zircon sand or silica sand is generally used as sand with binder, and particularly, it is desired to use the alumina sand which has an excellent binding force with carbonate salt. The zircon sand may be preferably used for preventing formation of shrinkage cavities and in an experience it has been found that a good result can be obtained in a case where the alumina sand containing 10–50% by weight (hereinbelow "%" or "parts" are referred to as "by weight") of zircon sand. A desired average particle distribution of the casting sand is about 35–150 meshes. In addition, it is preferable to use 10–50 parts of potassium carbonate with respect to 100 parts of the sand. With less than 10 parts of the potassium carbonate, a core having an insufficient as cast strength is produced and in over 50 parts thereof, the as cast strength of the core decreases. Therefore, it may be said that the core comprising the potassium carbonate of 10–30 parts is most suitable for the sand to be used.

The second binder, selected from the barium carbonate and alkali silicate, has a surprisingly improved mechanical strength when it is used in combination with potassium carbonate. It is desired to include 1–30 parts of the barium carbonate, preferably 1 –15 parts and the alkali silicate, preferably sodium silicate, in an amount of 1–15 parts, preferably 1–6 parts based on 100 parts of the sand. Where less than 1 part of the barium carbonate or alkali silicate is used, no good result can be obtained and when it is added in excess the fluidity of the core forming materials becomes "too high" to mold the core and in accordance with the increasing of the amount of the alkali silicate to be added the core has less disintegration ability after casting. Both of the barium carbonate and alkali silicate can be used singly or in combination in the amounts described above so as to greatly improve the as cast strength of the core. However, the increasing of the amount of the barium carbonate to increase strength against pressure results in the increasing of manufacturing cost for molding.

A suitable amount of water is usually added to the core materials for dissolving water soluble components in the materials thereby to give a desired consistency suitable for the resulting composition to be molded. Actually, 5–20 parts of water based on 100 parts of the sand are used to let the compositions become wet sand rather than slurry. (Since the alkali silicate is preserved in condition of water glass, the water amount contained in this condition should be considered.) It is preferable for the core to have less water content to shorten drying time of the core because of increase of the core strength by taking the moisture.

In an actual manufacturing process to form a water soluble core according to this invention, first, the water soluble potassium carbonate (or the potassium carbonate and alkali silicate in a case where alkali silicate is used) is dissolved into a predetermined amount of hot water having a temperature of about its boiling point. The solution thus prepared is then kneaded with the sand (or mixture of the sand and the barium carbonate when the barium carbonate is used) which was preliminarily heated to a temperature of about 100°–150° C. It is preferable to mix the solution with the sand before they have been cooled. The kneaded mixture is then poured into a predetermined mold frame, rammed and dried at a temperature of 80°–100° C. for 2–5 hours, and a core can be obtained by removing it from the mold frame. The core thus obtained is stored in a drier or moisture proof pack with silica gel to prevent degradation of the core due to moisture.

Under certain conditions, shrinkage cavities will be formed in the casting out of this mold for the reason that the core has relatively less heat conductivity and the molten metal is more slowly solidified at a portion near the core rather than at a portion in contact with the iron plates, which has relatively high heat conductivity. In such an undesirable case, the formation of the shrinkage cavities can be prevented by adding metallic powder or iron oxide red in an amount of 0.01–2 parts based on the sand of 100 parts without greatly lowering the strength of the core. The formation of the shrinkage cavities could be also largely suppressed by coating the iron oxide red or metalic powder on the surface of the core.

Figure 2:
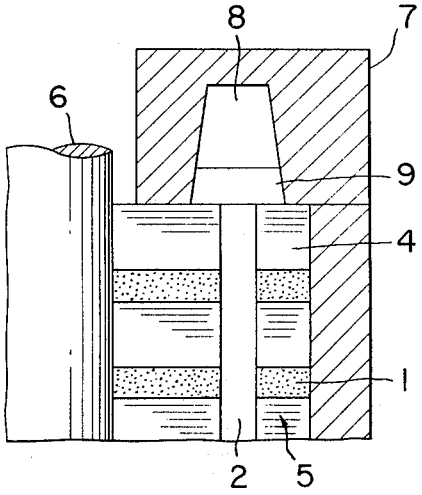
FIG. 2 is a partial longitudinal sectional view of a cast mold in which the duct spacers, shown in FIG. 1, are interposed between the laminated core blocks.

In conjunction with FIG. 2 through FIG. 4, described hereinbelow is a manufacturing process of a cast rotor which utilizes the core 1, as a duct spacer, molded by the process described above and shown in FIG. 1.

A plurality of laminated iron core plates 4, each of which has a predetermined outer diameter and provided with a central shaft hole 3 and conductor slots 2, are laminated while the corresponding positions of the holes, slots and the outerdiameters of the respective iron plates 4 are being exactly set by using a jig 6. After laminating the predetermined number of iron core plates 4, a duct spacer (core) 1 preliminarily manufactured is laminated thereon so as to communicate the central hole 3 and slots 2 with those of the iron core plates 4.

A plurality of blocks 5, each comprising the core 1 and iron plates 4 thus laminated, are laminated, then compressed and clamped, if necessary, together with the jig 6 (or rotor shaft), in a mold frame 7 by using a hydraulic machine, not shown. After these workings have been completed, the melt of aluminum is filled in spaces 2, 8 and 9 for forming conductors, cooling fins, and circuit rings, respectively, by die casting process or low pressure casting process.

Figure 3:
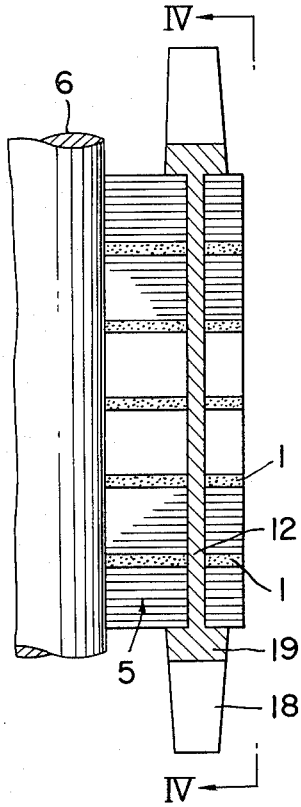
FIG. 3 shows a partial longitudinal sectional view of a cast product formed in the cast mold shown in FIG. 2.
Figure 4:
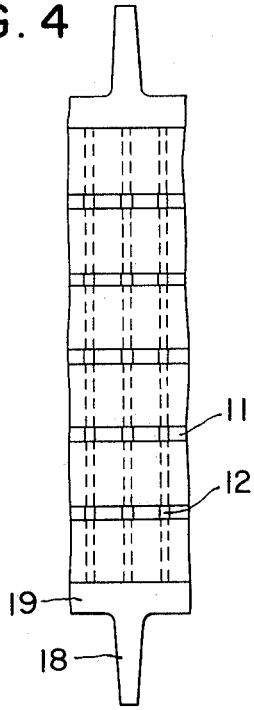
FIG. 4 shows a partial side view showing the surface of a cast rotor manufactured by the process according to this invention.

FIG. 3 shows a cast product taken out from the mold frame 7 and the product is provided with conductors 12, cooling fins 18, and the circuit rings 19, but the cores 1 still remain, which are then removed together with the water soluble binder contained in the core 1 by dipping the product into water or pouring water thereon. FIG. 4 shows a portion of a cast rotor provided with ventilation ducts 11 formed by removing the cores 1 in the manner described above.

Although the spacers 1 can be dissolved or disintegrated by water after the casting has been cooled, the cast rotor is easily dried by dissolving the spacers 1 before cooling because of the heat remaining in the casting and cores.

As described hereinabove, according to this invention, there is provided a water soluble core excellent in essentially required characteristics such as moldability, compressive strength (i.e., a withstand strength against pressure applied to compress the core), and disintegration ability, etc. and the core can define ventilation ducts between laminated core blocks. The invention also provides a method for easily and economically manufacturing process of a cast rotor provided with ventilation ducts by utilizing the core of this invention.

The following Table 1 shows tested results of moldability and disintegration ability of test pieces according to this invention. Each piece has a disc shape with a diameter of 50 mm and a height of 50 mm and is made of materials shown in Table 1. The test pieces were prepared by the steps of first kneading, for about 3 minutes, solution containing potassium carbonate (and sodium silicate) which is dissolved in a predetermined amount of boiling water with sand (and a powdery mixture of the sand and barium carbonate) preliminarily preheated to a temperature of about 150° C., then charging the kneaded material into a cylinder for producing a test piece before the kneaded material has been cooled, ramming it three times, drying the same at a temperature of 95° C. for 3 hours after removing from the cylinder, and finally cooling it in a dessicator. Alumina sand (grain size JIS (Japanese Industrial Standard) G5901 No. 5), zircon sand (grain size JIS G5901 No. 6), and silica sand (grain size JIS G5901 No. 5) were used as the sand.

The compressive strength in the Table 1 was measured by dividing breaking load by the cross-sectional area of the test piece in use of compression testing machine (defined in ASTM Standards E9 (section 2)) which can compress the core at a rate of 4 $Kg/cm^2$/second in compression. The moldability of the test core is evaluated by ramming the kneaded sand in the cylinder for producing the core. In this moldability test, the core in slurry state or in considerably dried sand condition was evaluated to be not good and is firmly rammed condition was evaluated to have a good moldability. In addition, the disintegration ability was evaluated by observing the disintegrated conditions of the test cores in cases where they were treated with by water.

TABLE 1

| Sample No. | Sand (Parts by wt) | (Parts by wt) | Barium Carbonate (Parts by wt) | Sodium Silicate (Parts by wt) | Water (Parts by wt) | Withstand Compression Strength ($kg/cm^2$) | Moldability, Disintegration Ability |
|---|---|---|---|---|---|---|---|
| 1 | alumina sand 100 | potassium carbonate 10 | — | — | 10 | — | impossible to test because of excessive hygroscopicity |
| 2 | " | 20 | — | — | 15 | 27.1 | good |
| 3 | " | sodium carbonate 20 | — | — | 15 | 4.5 | good |
| 4 | " | potassium carbonate 30 | — | — | 15 | 21.8 | good |
| 5 | " | 30 | 5 | — | 15 | 28.2 | good |
| 6 | " | 30 | 10 | — | 15 | 68.0 | good |
| 7 | " | 30 | 20 | — | 15 | 53.2 | relatively poor moldability and disintegration ability |
| 8 | " | 30 | 30 | — | 15 | 26.3 | relatively poor moldability and disintegration ability |
| 9 | " | 20 | — | 3 | 10 | 63.1 | good |
| 10 | " | 20 | — | 6 | 10 | 93.3 | good |
| 11 | " | 20 | — | 10 | 10 | 122.8 | good |
| 12 | " | 20 | — | 15 | 10 | 138.8 | relatively poor disintegration ability |
| 13 | " | 30 | — | 3 | 15 | 70.1 | good |
| 14 | " | 30 | — | 6 | 15 | 96.4 | good |
| 15 | " | 30 | — | 10 | 15 | 128.6 | good |
| 16 | " | 30 | — | 15 | 15 | 141.2 | relatively poor disintegration ability |
| 17 | " | 30 | 5 | 6 | 15 | 217.5 | good |
| 18 | " | 30 | 10 | 6 | 15 | 225.7 | good |
| 19 | " | 30 | 20 | 6 | 15 | 169.3 | relatively poor moldability and disintegration ability |
| 20 | " | 30 | 30 | 6 | 15 | 82.9 | relatively poor moldability |

TABLE 1-continued

| Sample No. | Sand (Parts by wt) | (Parts by wt) | Barium Carbonate (Parts by wt) | Sodium Silicate (Parts by wt) | Water (Parts by wt) | Withstand Compression Strength (kg/cm$^2$) | Moldability, Disintegration Ability |
|---|---|---|---|---|---|---|---|
| | | | | | | | and disintegration ability |
| 21 | " | 30 | 10 | 3 | 15 | 153.5 | good |
| 22 | " | 30 | 10 | 10 | 15 | 296.3 | good |
| 23 | " | 30 | 10 | 15 | 15 | 331.4 | relatively poor disintegration ability |
| 24 | " | 30 | 10 | 20 | 15 | 231.6 | poor disintegration ability and relatively poor moldability |
| 25 | " | 50 | 30 | 20 | 10 | 219.5 | poor disintegration ability and relatively poor moldability |
| 26 | " | 10 | 10 | 15 | 10 | 260 | relatively poor disintegration ability |
| 27 | " | 10 | — | 10 | 10 | 120 | good |
| 28 | " | 10 | 10 | — | 10 | 30 | good |
| 22 | " | 30 | 10 | 10 | 15 | 296.3 | good |
| 29 | zircon sand 100 | 30 | 10 | 10 | 15 | 275 | good |
| 30 | silica sand 100 | 30 | 10 | 10 | 15 | 255 | good |
| 31 | alumina sand 50 zircon sand 50 | 30 | 10 | 5 | 15 | 281.5 | good |
| 32 | alumina sand 100 | 50 | 50 | 15 | 20 | 242.3 | relatively poor moldability and disintegration ability |
| 32' | " | 10 | 1 | 1 | 10 | 45.2 | good |
| 33 | " | 10 | 1 | 15 | 10 | 138.8 | relatively poor disintegration ability |
| 34 | " | 10 | — | 15 | 10 | 91.7 | relatively poor disintegration ability |
| 35 | " | 50 | — | — | 20 | 18.6 | good |

From Table 1, it will be found that the compressive strength is greatly improved by applying, as a binder, at least one of barium carbonate and sodium silicate in addition to potassium carbonate and that a core having good moldability and disintegration ability as well as suitable compressive strength is obtained by selecting suitable combination ratio of the materials to be added. In this regard, it is noted that generally it is required for a water soluble core to have a compressive strength of more than 10 kg/cm$^2$ in gravity casting process, of more than 20 kg/cm$^2$ in a low pressure die casting process, and of more than 100 kg/cm$^2$ in die casting process.

The following Table 2 shows the results tested for evaluating the compressive strength (i.e., a withstand strength against a pressure applied on a core, moldability, and disintegration ability of the core prepared by adding an agent to sample No. 18 shown in Table 1 for preventing formation of shrinkage cavities in the casting. In view of Table 2, it is understood that metallic powder and iron oxide red can be added as an agent for preventing the formation of shrinkage cavities in the casting having good compressive strength, moldability, and disintegration ability.

TABLE 2

| Sample No. | Sand (Parts by wt) | Potassium Carbonate (Parts by wt) | Barium Carbonate (Parts by wt) | Sodium Silicate (Parts by wt) | Agents for Preventing Cavity Formation (Parts by wt) | Water (Parts by wt) | Withstand Compression Strength (kg/cm$^2$) | Moldability, Disintegration Ability |
|---|---|---|---|---|---|---|---|---|
| 18 | alumina sand 100 | 30 | 10 | 6 | — | 15 | 225.7 | good |
| 36 | " | " | " | " | metalic powder 0.3 | " | 150.5 | " |
| 37 | " | " | " | " | 0.5 | " | 165 | " |
| 38 | " | " | " | " | 1.0 | " | 193 | " |
| 39 | " | " | " | " | 2.0 | " | 100 | relatively poor moldability |
| 40 | " | " | " | " | iron oxide red 0.5 | " | 130 | good |
| 41 | " | " | " | " | 1.0 | " | 150 | " |
| 42 | " | " | " | " | 2.0 | " | 94 | " |
| 43 | zircon sand 100 | " | " | " | metalic powder 0.3 | " | 146.5 | " |
| 44 | " | " | " | " | 0.5 | " | 180 | " |
| 45 | " | " | " | " | 1.0 | " | 170.5 | relatively poor moldability |
| 46 | " | " | " | " | 2.0 | " | 165.5 | " |
| 47 | " | " | " | " | iron oxide red 0.5 | " | 124 | good |
| 48 | " | " | " | " | 1.0 | " | 146 | " |
| 49 | " | " | " | " | 2.0 | " | 172 | relatively poor moldability |

What is claimed is:

1. A water soluble core comprising a mold product prepared from a mixture consisting essentially of a sand in an amount of 100 parts by weight, a first binding agent of potassium carbonate in an amount of 10–50 parts by weight, and a second binding agent selected from the group consisting of at least one of barium carbonate in an amount of 1–50 parts by weight and 1–15 parts by weight of alkali silicate, and wherein said water soluble core is prepared by kneading a mixture of said sand, said first and second binding agents, and 5–20 parts by weight of water based on 100 parts by weight of said sand and said water soluble core is dried after molding.

2. A water soluble core as claimed in claim 1, wherein said second binding agent includes both said barium carbonate and said alkali silicate.

3. The water soluble core according to claim 1, which further comprises an agent for preventing formation of shrinkage cavities in said casting.

4. The water soluble core according to claim 3 wherein said agent comprises metallic powder.

5. The water soluble core according to claim 3 wherein said agent comprises iron oxide red.

6. A method of manufacturing a cast rotor of an induction motor comprising the steps of preparing a plurality of water soluble cores each comprising a mixture consisting essentially of sand in an amount of 100 parts by weight, a first binding agent of potassium carbonate in an amount of 10–50 parts by weight, and a second binding agent selected from the group consisting of barium carbonate in an amount of 1–50 parts by weight and alkali silicate in an amount of 1–15 parts by weight, each of said water soluble cores being provided with a shaft hole and a plurality of conductor slots, interposing said water soluble cores between adjacent laminated core blocks each having a shaft hole and a plurality of slots corresponding to those of said water soluble cores so as to align said water soluble cores and said laminated core blocks to form a laminated assembly, positioning said laminated assembly in a casting mold, pouring electrically conductive molten metal into said casting mold to form conductors, circuit rings, and cooling fins of said cast rotor, and treating with, by water, a cast product taken out from said cast mold thereby to disintegrate said water soluble cores to form ventilation ducts.

7. The method of claim 6, wherein said second binding agent includes both said barium carbonate and said alkali silicate.

* * * * *